US006182581B1

(12) United States Patent
Boyce

(10) Patent No.: US 6,182,581 B1
(45) **Date of Patent: *Feb. 6, 2001**

(54) MODULAR TABLE

(75) Inventor: David L. Boyce, Damascus, PA (US)

(73) Assignee: Boyce Products, Ltd., Damascus, PA (US)

( * ) Notice: Under 35 U.S.C. 154(b), the term of this patent shall be extended for 0 days.

This patent is subject to a terminal disclaimer.

(21) Appl. No.: 09/409,517

(22) Filed: Sep. 30, 1999

(51) Int. Cl.[7] ..... A47B 85/00
(52) U.S. Cl. ..... 108/64
(58) Field of Search ..... 108/64, 65, 90, 108/50.02, 150; D6/489, 480, 483, 486

(56) References Cited

U.S. PATENT DOCUMENTS

| | | | |
|---|---|---|---|
| D. 291,853 | 9/1987 | Worrell et al. . | |
| D. 336,191 | 6/1993 | Deimen et al. . | |
| D. 370,807 | 6/1996 | Maple . | |
| 3,053,598 | 8/1962 | Cheslow . | |
| 3,342,147 | 9/1967 | Shettles . | |
| 3,533,362 | 10/1970 | Thompson . | |
| 3,741,852 | 6/1973 | Keener . | |
| 4,039,187 * | 8/1977 | Shea | 108/64 X |
| 4,732,088 | 3/1988 | Koechlin et al. . | |
| 4,922,835 | 5/1990 | Van Vliet et al. . | |
| 5,438,937 | 8/1995 | Ball et al. . | |
| 5,595,126 | 1/1997 | Yeh . | |
| 6,012,398 * | 1/2000 | Boyce | 108/64 X |

FOREIGN PATENT DOCUMENTS

| | | | |
|---|---|---|---|
| 1276836 * | 6/1972 | (GB) | 108/64 |

* cited by examiner

*Primary Examiner*—Janet M. Wilkens
(74) *Attorney, Agent, or Firm*—Rhodes & Mason, PLLC

(57) ABSTRACT

A modular table, such as a conference table is constructed of a plurality of detachable, connected modules. Each module has a three-sided top formed by connecting three three-sided sections. Each three-sided section has a base side forming an outer edge of the module top, a first side and a second side. The first and second sides are joined at an angle of 120°, and are preferably of different lengths, so that a central opening is formed in the top of each module. The base side of at least one section of each module is convex. A base supporting each module preferably has an opening so that utilities can be connected from a floor beneath the table to the table top through openings in the modules and base.

20 Claims, 4 Drawing Sheets

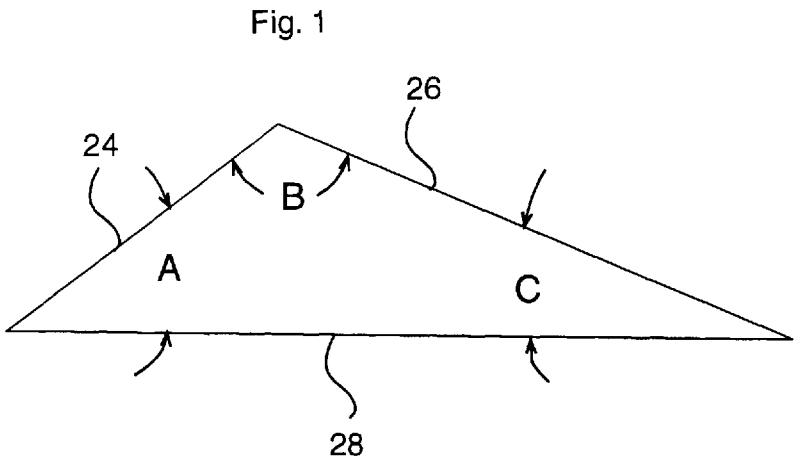
Fig. 1
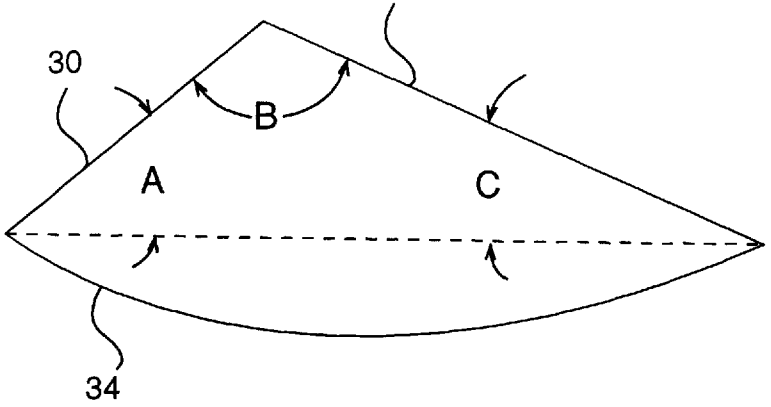
Fig. 2
Fig. 3
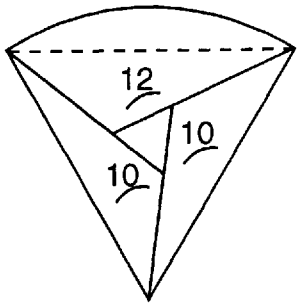
Fig. 4
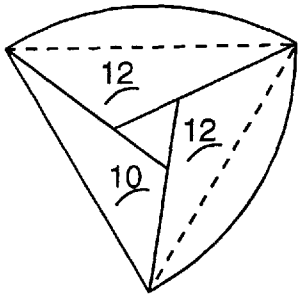
Fig. 5
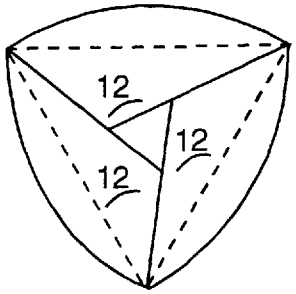
Fig. 6

MODULAR TABLE

BACKGROUND OF THE INVENTION (1) Field of the Invention

The present invention relates generally to a modular table, such as a conference table, and in particular to a modular table formed of a plurality of modules, each module having a central opening and being formed of three, three-sided sections.

(2) Description of the Prior Art

It is known in the prior art to form a table of a size that will accommodate the presence of several persons, such as a conference table, by attaching several sections or modules so that their tops are fitted together in a common plane to form the top of a single table. Generally, each module is comprised of a horizontal, planar top, and a support base, which may be of various forms, such as a pedestal or a plurality of legs.

The modules that are joined to form the table may be of a plurality of shapes, such as those illustrated in the following patents:

| | |
|---|---|
| 5,595,126 | Yeh |
| 3,741,852 | Keener |
| 3,053,598 | Cheslow |
| 4,922,835 | Van Vliet et al. |
| 5,438,937 | Ball et al. |
| 4,732,088 | Koechlin et al. |

Alternatively, the table can be formed of a plurality of identical modules, such as those described in U.S. Pat. No. 3,342,147 to Shettles al., relating to a table constructed from a plurality of triangular-shaped individual table modules with solid one-piece tops.

These prior art modular tables, however, do not make any provision for utilization with modem computing equipment or other electrical or electronic equipment that must be attached to electrical outlets or other utility outlets that are frequently positioned in the floor beneath the table. In addition, the tops of the modules are costly to manufacture, or have such a small surface area that several modules must be joined to form a work surface suitable for several people. In other constructions, the table requires the joinder of several different shaped modules, resulting in a more expensive product to manufacture, and reducing the number of possible table configurations.

Commonly-assigned U.S. patent application Ser. No, 09/216,717, filed Dec. 12, 1998, now U.S. Pat. No. 6,012, 398, issued Jan. 11, 2000 incorporated herein by reference in its entirety, describes an improved modular table, such as a conference table, comprised of a plurality of modules that can be arranged in a variety of designs to produce tables of different shapes. Each module has a top with an exterior periphery in the shape of an equilateral triangle, i.e., the top has three sides of equal length. The center of the modular top includes an opening providing access to the floor beneath the table. Each top is formed of three identical triangular sections, each having first and second sides, with the second side being longer than the first side, and a base side that is longer than the second side. The triangular sections are attached to each other in a common plane, with the bases of the triangular sections forming the periphery of the module. That is, when assembled, the base side of each triangular section forms one exterior side of the module.

The table described in the above application exhibits several desirable properties, including ease and economies of manufacture, and the flexibility to assemble the table modules in numerous ways to provide tables of the desired overall configuration. However, there is still a need for conference tables, and other tables that can be configured in yet other designs that are not possible with the sections provided in the above application.

SUMMARY OF THE INVENTION

The present invention is directed to tables, such as conference tables, comprised of a plurality of modules that can be arranged in a variety of designs to produce tables of different shapes. Each module has a top with a three-sided exterior periphery, and is constructed of three three-sided sections, each having a base side, and first and second side. The three-sided sections are attached to each other in a plane, with the base sides of the three-sided sections forming the periphery of the module. That is, when assembled, the base side of each three-sided section forms one side of the module.

Unlike the modules described in the foregoing application, which are constructed of three identical sections, the modules of the present invention are constructed by combining sections of two different designs. The modules of the present invention can then be combined with each other and/or with the modules described in the foregoing application to form modular tables of various designs.

The present modules are constructed of a first section that is the same as the section used to construct modules in the foregoing application, and a second section differing from the first section in that the base side of the section is convex. In addition, a table can be formed by combining three of the second sections.

In the first section, each side is straight, and the angle at the juncture of the first and second sides, i.e., the apex of the triangle, is 120°. Therefore, the sum of the angles between the base and the first side, and the base and the second side is equal 60°. Preferably the angle between the base and the first side is from about 31° to about 45°, and even more preferably, for about 35° to about 40°.

The second section differs from the first section in that the base side of the three-sided section, i.e., the side forming a part of the outer periphery of the module, is convex instead of straight. That is, the base side of the section curves outwardly from the other two sides of the module section. As will be seen in the attached drawings, a combination of these first and second sections can be used to produce three-section modules of various useful designs. Moreover, three of these second sections can also be combined to form a table top that can be used alone.

The second modular section is similar to the first section, in that it is has first and second sides and a base side, and three corners. The angle at the juncture of the first and second sides is 120°. The sum of the angles between a straight line drawn through the corners at each end of the base side, referred to herein as the baseline, and the first and second sides is equal 60°. Preferably the angle between the baseline and the first side is from about 31° to about 45°, and even more preferably, for about 35° to about 40°, with the angle between the baseline and the second side being the difference between 60° and the angle between the baseline and the first side.

A module can be assembled by combining three of the first sections as shown in the foregoing application; three of the above-described second section; two of the first sections with one of the second sections; or two of the second sections with one of the first sections. All sections used in forming a given module will have first sides of the same length, and second sides of the same length.

When a module is assembled, the first side of each section is aligned with and abuts the second side of another section. All of the triangular sections are turned in either a clockwise or counter-clockwise direction when viewed from the top. As a result, of this orientation, the fact that the first side of each segment is shorter than the second side, and the fact that the first and second sides of all sections forming a given module have the same dimensions, a triangular-shaped opening is left in the center of the assembled module so that utilities can be extended from beneath the table to the table surface.

Modular table tops can be constructed of various combinations of modules. That is, a table top can be constructed of at least two modules, with each module being constructed of two of the first sections and one of the second sections. Other table tops can be constructed of at least two modules, with each module being constructed of one of the first sections and two of the second sections. Still other tables can be constructed of at least two modules, with one module being formed of two of the first sections and one of the second section, and the other module being formed of one of the first sections and two of the second sections.

When two sections are assembled to form a table top, the base side of one of the sections of each module will be positioned to abut the base side of a section of another module. As will be seen in the illustrations, the radius of curvature of the convex base side of the second section is preferably equal to the length of the baseline, i.e., the distance between the ends of the base side. With this radius of curvature, six modules, each constructed of two of the first sections and one of the second sections, can be assembled with the junctures of their first and second sides together to form a table top with a circular periphery.

Each module also includes a base or support that is positioned under the central opening in the module. Preferably, the base includes a central opening or conduit extending from the bottom to the top of the base. Preferably, the base is also constructed of three identical sections, with central vertical openings positioned beneath the tabletop opening.

When the base is placed over a utility outlet in the floor beneath the table, utilities or wiring can be extended from the floor through the base central opening and then through the tabletop opening above the base. For example, the base may be comprised of three leg segments that are joined together around a central triangular opening. This central base opening can then be placed directly beneath the opening in the module top to form a continuous pathway for wiring and other utilities from the floor to the table top.

Accordingly, it is an object of the invention to provide a table module comprising a three-sided top having an upper surface and a lower surface, the top being formed of three three-sided sections, each of the sections having a base side forming an outer edge of the top, a first side and a second side, the first and second sides being joined at an angle of 120°, one section having a convex base side, and a base supporting the top.

Another aspect is to provide a module of the above configuration including a central opening resulting from the second side of each of the sections being longer than the first side, the base including an opening beneath the top central opening, whereby utilities can be connected from beneath the top through the base opening and the top opening.

It is another aspect of the invention to provide a modular table constructed of a plurality of connected modules of the above configuration.

It is still another object to provide a modular table top comprised of three sections joined in a common plane, each section having a straight first side, a straight second side longer than the first side, and a convex base side with ends separated at a distance longer than the second side.

These and other aspects of the present invention will become apparent to those skilled in the art after a reading of the following description of the preferred embodiment.

BRIEF DESCRIPTION OF THE DRAWINGS

FIG. 1 is a top view of a section described in the foregoing application.

FIG. 2 is top view of a section in accordance with the present invention.

FIG. 3 is a top view of a modular top constructed of three of the sections shown in FIG. 1.

FIG. 4 is a top view of a modular top constructed of two of the sections shown in FIG. 1 and one of the sections shown in FIG. 2.

FIG. 5 is a top view of a modular top constructed of one of the sections shown in FIG. 1 and two of the sections shown in FIG. 2.

FIG. 6 is a top view of a modular top constructed of three of the sections shown in FIG. 2.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. Like elements are designated by like numbers. The drawings are for the purpose of illustrating the invention and are not intended to be to scale.

The present invention is directed to modular tables comprised of a plurality of modules, and to the construction of such modules. Each module top is constructed by combining three sections, selected from first section 10 and second section 12, illustrated in FIGS. 1 and 2, respectively. Possible three-sided module tops that can be constructed from combinations of sections 10 and/or 12 are the module tops illustrated in FIGS. 3, 4, 5, and 6.

Figure 7:
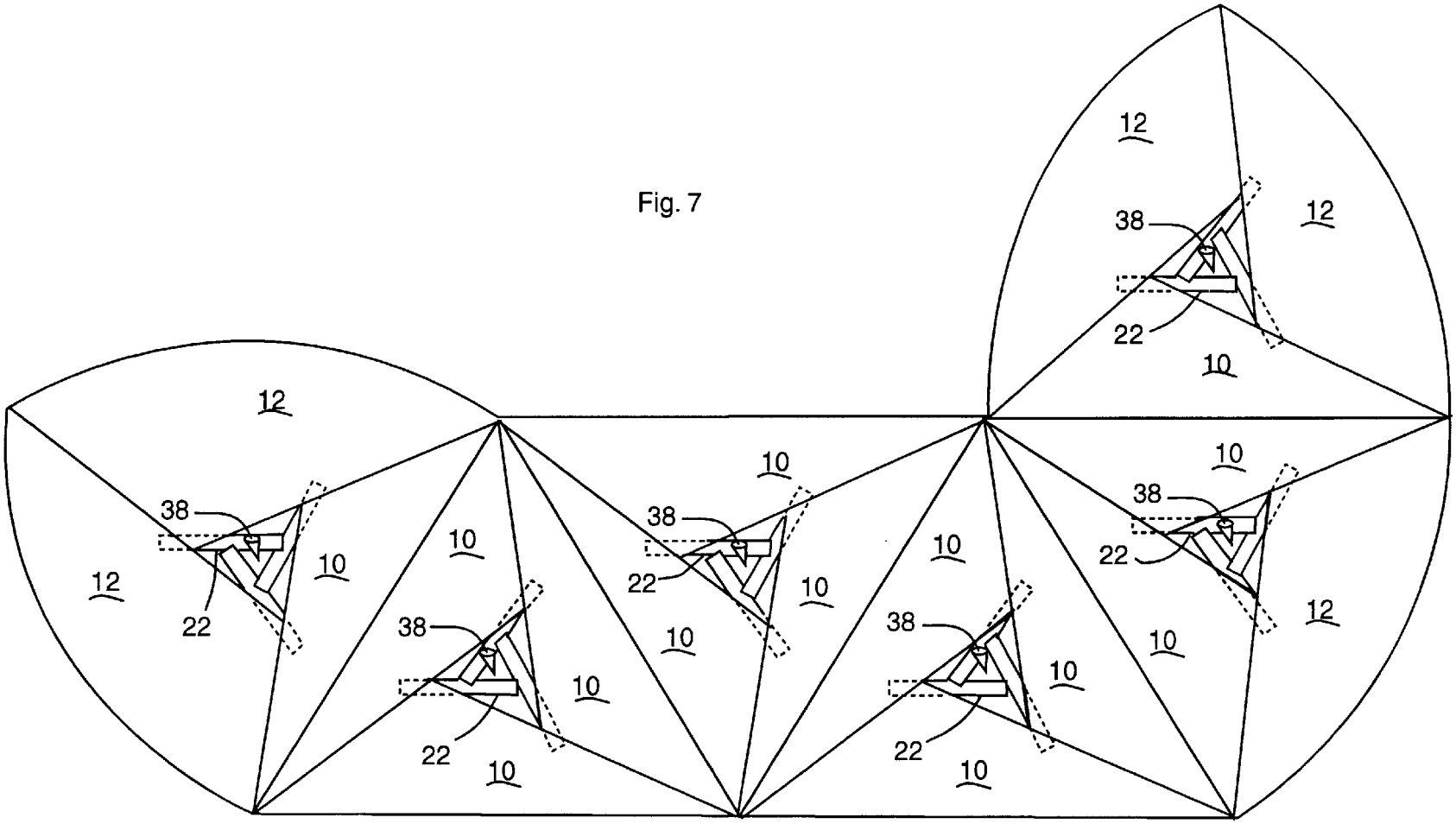
FIG. 7 is a top view of a modular table constructed of three of modules shown in FIG. 3, one of modules shown in FIG. 4, and two of modules shown in FIG. 5.
Figure 8:
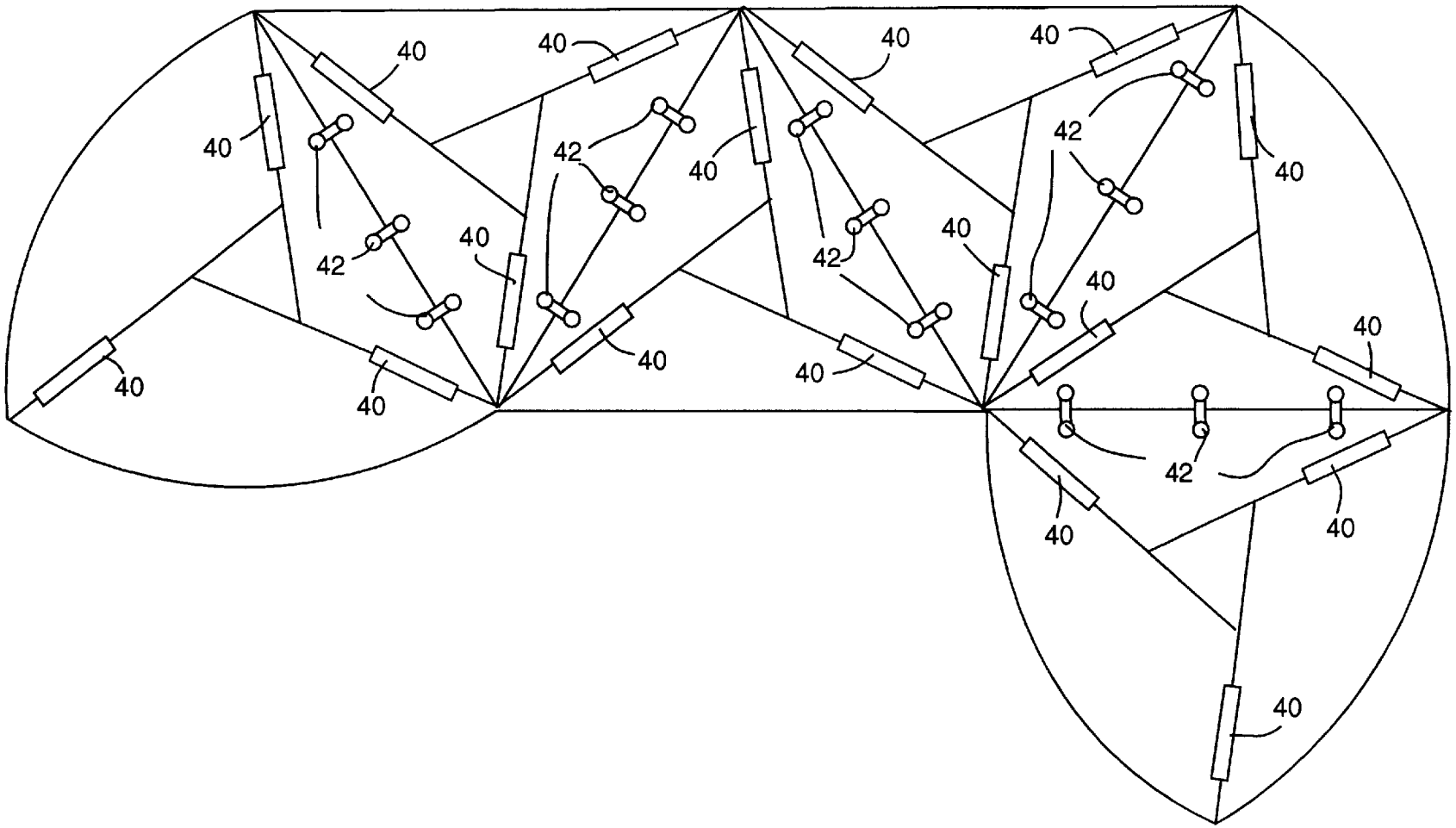
FIG. 8 is a bottom view of the modular table top shown in FIG. 7.
Figure 10:
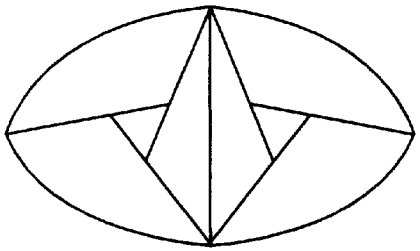
FIGS. 9, 10 and 11 are top views of some other possible modular table top configurations.
Figure 12:
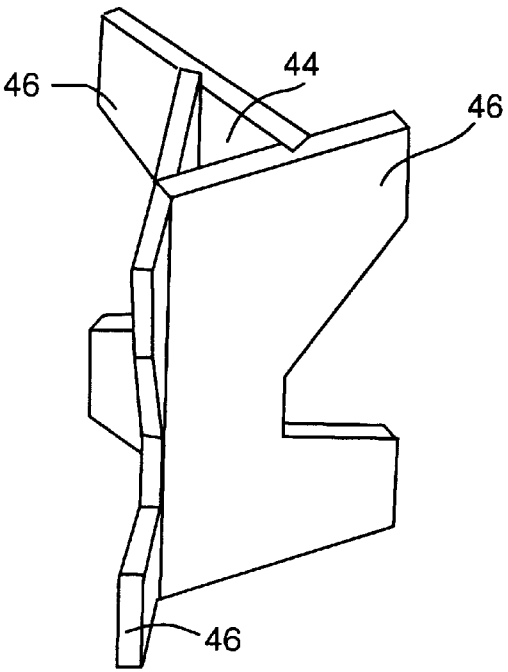
FIG. 12 is a perspective view of a base of a table module.
Figure 9:
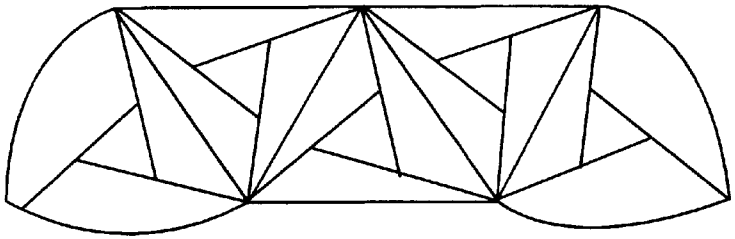
Figure 11:
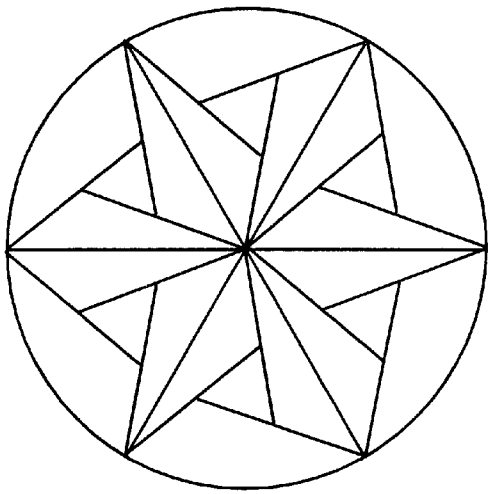

These module tops, each supported on a base member 22, can be assembled into various configurations. One possible table configuration is shown in FIGS. 7 and 8. In this embodiment, a total of six modules in a common plane, i.e., three of modules 14, one of module 16, and two of module 18, are joined to form the table. Other table top configurations are illustrated in FIGS. 9, 10 and 11.

As illustrated in FIG. 1, each top section 10 has a first side 24, a second side 26, and a base side 28. Base side 28 of section 10 is oriented to the outside of the module top to form a part of the peripheral edge. Each first side 24 abuts, and is attached to, the second side of an adjacent section 10 or 12, depending on the module constructed.

Top section 12 has a first side 30, a second side 32, and a convex base side 34. Like section 10, base side 34 is oriented to the outside of the module top to form a part of the peripheral edge of a module. Each first side 30 abuts, and is attached to, the second side 26 or 32 of an adjacent section 10 or 12, respectively, depending on the module constructed. Unlike base side 28 of section 10, which is straight, base side 34 of section 12 is convex.

The respective angles of the sides of both sections are critical to the construction of the module top. Referring to FIG. 1, angle (B) at the joinder of sides 24 and 26 must be 120° in order for the three sections to form a module. Since the sum of the three angles must equal 180°, and since no opening will be left in the center of the module top if angles (A) and (C) are the same, angle (A) must be greater than angle (C) in order for there to be an opening in the center of the module.

In other words, angle (A) is greater than 30°, while angle (C) is equal to 60° minus the angle of angle (A). Therefore, the sum of the angles between the baseline and the first side, and the baseline and the second side will equal 60°. In the section illustrated in FIG. 1, angle (B) is 120°, angle (A) is approximately 38°, and angle (C) is approximately 22°.

Similarly, sides 30 and 32 of section 12 illustrated in FIG. 2 must meet at a 120° angle, designated as angle (B), and angle (A) must be greater than angle (C) in order for there to be an opening in the center of a module formed from sections 12. Angles (A) and (C) in FIG. 2 are measured between sides 30 and 32, respectively, and an imaginary line extending through the ends of base side 34, shown in the drawings as dotted baseline 36.

The radius of curvature of convex base side 34 of section 12 is preferably equal to the length of base line 36. With this radius of curvature, six modules, each constructed of two of section 10 and one of the section 12, can be assembled with the junctures of their first and second sides together to form a table top with a circular periphery as shown in FIG. 11.

Since angles (A) and (C) are different in each section, an opening 38 remains in the center of each module after the three sections 10 and/or 12 have been assembled, permitting wiring, cables and other connectors, referred to herein collectively as utilities, to be brought up through the center of the module, instead of around the edges, where the wiring could interfere with the seating of personnel.

As best seen in FIG. 8, sections 10 and/or 12 are joined at their abutting edges with strip fasteners 40 that are screwed into the under surfaces of sections 10 and/or 12, forming a more or less permanent structure. The tops of modules 14, 16, 18 and/or 20 are then releasibly attached to each other with releasable fasteners 42, which are preferably of a different construction from fasteners 40 to permit ease of assembly and reassembly of the modules to construct tables of different sizes and configurations.

Each module top is supported on a base, generally 22, that includes an opening 44 aligned beneath opening 38 in the supported top. As a result, base 22 can be positioned over a floor outlet (not shown) and utilities can be strung from the outlet through openings 44 and 38 to the top of the table.

The exact configuration of base 22 is not critical to the invention, so long as an opening beneath module top opening 38 is a part of the base structure. In the illustrated preferred embodiment, base 22 is constructed of three identical rectangular legs 46. Each leg 46 includes a side edge attached equidistant along the inner side wall of the other leg 46. As a result, opening 44 is in the shape of a triangular conduit extending from the floor to the under surface of the table top, thereby hiding and protecting any utilities that are strung through opening 44.

Certain modifications and improvements will occur to those skilled in the art upon a reading of the foregoing description. Such modifications and improvements have been deleted herein for the sake of conciseness and readability but are properly within the scope of the follow claims.

What is claimed is:

1. A table module comprising:

a) a three-sided top having an upper surface and a lower surface, said top being formed of three three-sided sections, each of said sections having a base side forming an outer edge of said top, a first side and a second side, said first and second sides being joined at an angle of 120°, the base side of at least one of said sections being convex; and b) a base supporting said top.

2. The table module of claim 1, wherein said top includes a central opening, and said base includes an opening beneath said top central opening, whereby utilities can be connected from beneath said top through said base opening and said top opening.

3. The module of claim 1, wherein the second side of each of said sections is longer than the first side.

4. The module of claim 1, wherein the first side of each section abuts the second side of another section.

5. The module of claim 1, wherein said base is formed of legs joined to form a central opening extending from the bottom of said base to the top of said base.

6. A module with a three-sided modular top having an upper surface and a lower surface, said top being formed of a total of three sections selected from a) first section having straight first, second and base sides, the first and second sides of said first section being joined at an angle of 120°; and b) second section having straight first and second sides, and a convex base side, the first and second sides of said second section being joined at an angle of 120°, the first and second sides of all sections being of the same length, with the second sides being longer than the first sides, said first sides abutting second sides of adjacent sections, whereby an opening is formed in the center of said top.

7. The module of claim 6, further including a base supporting said top, said base having a top and a bottom, and an opening extending from the top to the bottom of said base, said base being positioned with the base opening beneath the top opening.

8. The module of claim 6, wherein the radius of curvature of the base side of said second section is equal to the distance between the ends of said base side.

9. The module of claim 6, formed of two of said first section and one of said second section.

10. The module of claim 6, formed of one of said first section and two of said second section.

11. A table comprised of:

a) a plurality of connected three-sided modular tops with upper and lower surfaces, each of said modular tops being formed of three three-sided sections, each of said sections having a base side forming an outer edge of said top, a first side and a second side, said first and second sides being joined at an angle of 120°, the base side of at least one of said sections being convex; and b) bases beneath each of said modular tops.

12. The table of claim 11, wherein each module top includes a central opening, and each base includes an opening beneath said module top central opening, whereby utilities can be connected from beneath said top through said base opening and said top opening.

13. The table of claim 11, wherein the second side of each of said modular top sections is longer than the first side.

14. The table of claim 11, wherein the second side of each section abuts the first side of another section.

15. The table of claim 11, wherein each of said base is formed of legs joined to form a central opening extending from the bottom of said base to the top of said base.

16. A table comprised of a plurality of connected three-sided modular tops with upper and lower surfaces, each of said tops being formed of a total of three adjacent sections selected from a) first section having straight first, second and base sides, the first and second sides of said first section being joined at an angle of 120°; and b) second section having straight first and second sides, and a convex base side, the first and second sides of said second section being joined at an angle of 120°, the first and second sides of all sections being of the same length, with the second side of each section being longer than the first side of each section, the first side of each section abutting the second side of an adjacent section, whereby an opening is formed in the center of each of said tops.

17. The table of claim 16, further including a support base beneath each of said modular tops, each base having a top and a bottom, and an opening extending from the top to the bottom of said base, each base being positioned with the base opening beneath a top opening.

18. The table of claim 17, wherein the opening in each base is in the shape of an equilateral triangle.

19. The table of claim 16, wherein the radius of curvature of the base side of said second section is equal to the distance between the ends of said base side.

20. The table of claim 16, formed of six of said modular tops with the apexes of the first and second sides of each modular top abutting the apexes of the first and second sides of the other modular tops, the radius of curvature of the base sides of all modular tops being equal to the distance between the ends of the base sides, and all modular tops being of the same dimensions, whereby the base sides of the modular tops form a circular periphery.

* * * * *